United States Patent [19]

Lane

[11] 4,345,639

[45] Aug. 24, 1982

[54] HEAT STORAGE UNITS

[75] Inventor: Richard J. Lane, Moddershall, Near Stone, England

[73] Assignee: Ti Creda Manufacturing Limited, Stoke on Trent, England

[21] Appl. No.: 55,000

[22] Filed: Jul. 5, 1979

[51] Int. Cl.[3] ..... F28D 17/00; F24H 7/04

[52] U.S. Cl. ..... 165/10; 219/365; 219/378

[58] Field of Search ..... 165/18, 48, 104 S, 58, 165/10 A; 219/365, 378

[56] References Cited

U.S. PATENT DOCUMENTS

| | | | |
|---|---|---|---|
| 2,723,083 | 11/1955 | Bary | 219/378 X |
| 3,292,854 | 12/1966 | Webb | 219/378 X |

FOREIGN PATENT DOCUMENTS

| | | | |
|---|---|---|---|
| 657973 | 2/1963 | Canada | 219/365 |
| 1454305 | 3/1969 | Fed. Rep. of Germany | 219/378 |
| 2255452 | 5/1974 | Fed. Rep. of Germany | 219/365 |
| 2310535 | 12/1976 | France | 219/365 |
| 1254691 | 11/1971 | United Kingdom | 219/365 |
| 1279404 | 6/1972 | United Kingdom . | |
| 1337387 | 11/1973 | United Kingdom . | |

*Primary Examiner*—Albert W. Davis

*Attorney, Agent, or Firm*—Merriam, Marshall & Bicknell

[57] ABSTRACT

A heat storage unit of the kind comprising a housing in which heat storage elements are contained, with a common passage extending through the heat storage elements, and through which air is fed by a fan to remove heat from the storage elements to apply the heat to the room being served by the unit. To permit the unit to provide for circulation of air in the room being served, without raising the temperature of the air by contact with the heat storage elements, a valve means is provided which is movable between a first condition in which air flows from an air inlet of the unit to an air outlet at least in part through the heating passage, and a second condition in which said air flows from the inlet to the outlet directly, and not by way of the heating passage.

To prevent or minimize undesired dissipation of heat from the heat storage elements by leakage of air through the heating passage, both the inlet and outlet sections of the heating passage open into an ancillary chamber, the valve means when the unit is operating in its cool running condition being effective to close the ancillary chamber.

In this way, since the heating passage does not open directly into the valve chamber, no significant pressure differential will be created between the two ends of the heating passage, as would tend to cause flow of air through the heating passage and undesired heating of air flowing through the unit when operating in its cool running condition.

13 Claims, 4 Drawing Figures

HEAT STORAGE UNITS

BACKGROUND OF THE INVENTION (1) Field of the Invention

This invention is concerned with improvements relating to heat storage units.

In heat storage units it is practice to remove heat from the storage section by drawing air through an air inlet into the unit, by means of an impeller device of the unit, passing such air along a heating passage or passages extending through the heat storage section, and to deliver such air to the room being served by the unit through an air outlet.

It has been suggested that it would be convenient to be able to use the impeller device of the heat storage unit to draw air through the air inlet into the unit, and to deliver such air directly through the air outlet, without the air passing through the heating passages. In this manner the impeller device of the storage unit could be used to provide for circulation of air without causing heating of the air.

(2) Description of the Prior Art

A conventional heat storage unit comprises a valve chamber above which the heat storage section is mounted: the heating passages extend from one part of the chamber through the heat storage section, between the heat storage elements thereof, returning to a different part of the chamber. Thus, it has been suggested to provide valve means movable between a first condition (in which the heat storage unit may be said to be operating in its cool running condition) in which the flow of air from the air inlet to the air outlet is directly through the valve chamber, and a second condition (in which the storage unit may be said to be operating in its heating condition) in which such air flows from one part of the valve chamber to the other by way of the heating passage or passages.

In previous suggestions the valve means, when in its first condition, has been operative to close off the heating passages whilst permitting flow of air directly through the valve chamber. In one such previous suggestion, the valve means was operative to close off the heating passage at the point of its exit from the valve chamber, whilst in another previous suggestion, separate valve elements were provided which were operative to close off the heating passage both at the point of its exit from the valve chamber and at the point of its return to the valve chamber. Examples of such previous suggestions may be found in U.K. Patent Specification No. 1,254,691 and in German OLS No. 683,372.

In all previous suggestions, difficulty has been encountered in preventing air flow through the heating passages to the required extent, when operating the storage unit in the cool running condition. It has been discovered that this difficulty is primarily caused by the existence of a pressure differential between the two parts of the valve chamber from which the heating passages extend from and return to the valve chamber when the heat storage unit is operating in its cool running condition, together with the difficulty of providing a closing off of the heating passages to an extent sufficient to prevent significant flow of air under the influence of this pressure differential. Such difficulties are exacerbated (a) by the temperature at which it is necessary for the valve means to be effective, and (b) by the fact that, when in its fully charged condition, a very small flow of air through the heating passages can cause a significant dissipation of the heat stored in the heat sorage elements. Whereas such dissipation is not necessarily significant in relation to the rise in temperature which it creates whilst the storage unit is operating in its cool running condition, it may be significant in relation to the capability of the unit to retain sufficient store heat for the subsequent period when it is desired to utilise the unit in the maintenance of an optimum temperature in the room being served by the unit.

Thus, previous suggestions, to use the impeller device of the storage unit to provide for circulation of the air without causing heating of the air, have not been successful.

SUMMARY OF THE INVENTION

According to this invention there is provided, in a heat storage unit of the kind comprising a housing; an air inlet and an air outlet extending into the housing; heat storage elements mounted in the housing, said heat storage elements defining passage means extending between the heat storage elements; a valve chamber in the housing from which the passage means extends and to which the passage means returns; impeller means connected to the housing and being operative to cause air to flow into the housing through the air inlet, through the valve chamber and from the air outlet; valve means mounted in the valve chamber, and drive means connected to the valve means between a first condition in which the impeller means is operative to cause air to flow from the inlet to the outlet at least in part through said passage means, and a second condition in which said impeller means is operative to cause air to flow from the inlet to the outlet predominantly directly through the valve chamber, the improvement wherein there is provided in the valve chamber an ancilliary chamber the improvement wherein there is provided in the valve chamber an ancilliary chamber from which the passage means extends and to which the passage means returns, said ancilliary chamber having an opening which opens into the valve chamber and the valve means when in its second condition closes said opening.

Thus, when the valve means is in its second condition, air may flow directly through the valve chamber from the inlet to the outlet. Since the heating passage does not open directly into the valve chamber, no significant pressure differential will be created between the two ends of the heating passage, as would tend to cause flow of air through the heating passage. Any pressure differential between the valve chamber and the ancilliary chamber, which may be created by an inadequate closure of the intermediate chamber by the valve means, affects both ends of the heating passage uniformly, and will not be effective to cause significant flow of air through the heating passage.

Thus, the valve means, inasmuch as it is operative to close the ancilliary passage, need not be a perfect seal, and it has in fact been found that a lower degree of sealing of the ancilliary chamber, compared with valve elements operative independently to seal the ends of the heating passage, is more effective in preventing significant flow of air through the heating passage.

The valve means preferably comprises a first valve member which when in a second position closes said opening, and which when in a first position divides the ancilliary chamber into an inlet section which is in communication with the inlet section of the heating passage, and an outlet section which is in communication with the outlet section of the heating passage.

Preferably, the valve means comprises a second valve member which is also movable between first and second positions and which, when in its first position, cooperates with the first valve member to divide the valve chamber into an inlet section between the air inlet and the inlet section of the heating passage and an outlet section between the air outlet and the outlet section of the heating passage. Preferably the second valve member is such that, when in its second position, it presents minimum impedance to the flow of air through the valve chamber from the air inlet to the air outlet.

Both the valve members may be continuously positionally variable, the drive means of the storage unit being operative to move the valve members between their first positions synchronously, to vary the proportion of air flowing from the inlet to the outlet by way of the heating passage, to the proportion of air flowing from the inlet to the outlet other than by way of the heating passage.

Alternatively, the first valve member may be bistable (that is, being stable only in its first or second positions, and being incapable of adopting an intermediate position) and the proportion of air flowing from the inlet to the outlet by way of the heating passage and the proportion of air flowing from the inlet to the outlet other than by way of the heating passage may be varied by variable positioning of the second valve member, separate motive means being provided to move the second valve member between its first and second positions.

In either case, the drive means is conveniently afforded by a drive motor operative under the influence both of a sensing device which is operative to sense the temperature of air flowing from the device, and a present control.

Additionally, whereas it has previously been suggested to incorporate, in a heat storage unit, cooling means which may be effective to cool air flowing through the device in its cool running condition, to increase the capability of the device in the maintenance of optimum temperature conditions in the room or premises being served, heretofore the slow leakage of heat which has taken place from the heat storage elements, with the device operating in its cool running condition, has meant that the employment of such cooling means has not been effective, or has not been effective to an extent such as to be a commercial practical proposition. However, inasmuch as the present invention permits a storage unit to be operated in a cool running condition with no or with no effective leakage of heat from the heat storage elements, this permits the heat storage unit to comprise, or to be used in conjunction with, cooling means which is effective to lower the temperature of air flowing through and/or emitted from the device when the device is operating its cool running condition, to lower the temperature of the room being served, notwithstanding the presence of any stored heat within the heat storage section of the units.

Additionally, the storage unit may comprise, or be used in conjunction with, heating means which is effective to increase the temperature of air emitted from the device in circumstances where the residual heat content of the storage unit is too low to raise the temperature of the air to a desired temperature, or where it is desired not to deplete the heat content of the storage unit.

Thus, conveniently, the outlet is connected to an auxilliary unit through which air flows from the heat storage unit to the room being served, said auxilliary unit comprising means to heat air flowing therethrough, and to cool air flowing therethrough, as may be desired.

DETAILED DESCRIPTION OF THE PREFERRED EMBODIMENTS

Figure 1:
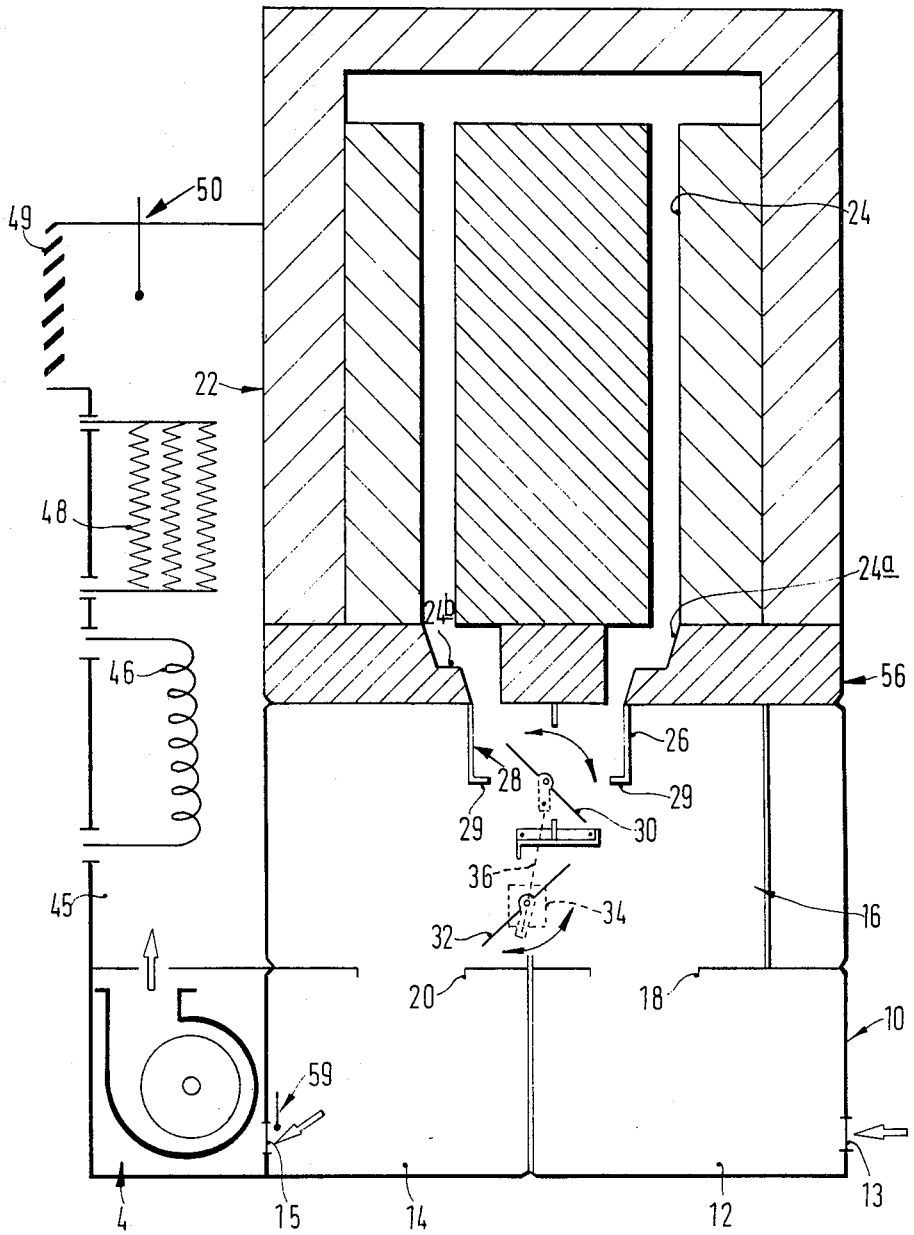
FIG. 1 is a schematic cross-sectional view of a heat storage unit which is a first embodiment of the invention, and which has been selected to illustrate the invention by way of example.

The heat storage unit which is the first embodiment of this invention comprises a lower, plinth section 10 divided into inlet and outlet chambers 12, 14 respectively, ducting connector pieces 13, 15 being provided which afford an air inlet and an air outlet, respectively, and a valve chamber 16 superposed on the plinth section 10. The valve chamber is provided with openings 18 and 20 communicating respectively with the inlet and outlet chambers.

Mounted above the valve chamber is a conventional heat storage section 22, provided with a heating, or core passage 24 extending between the heat storage elements of the section. Between the heat storage section 22 and the valve chamber 16 there is provided an intermediate member 56 which is effective to bring the inlet and outlet branches **24*a*, 24*b*** of the core passage somewhat closer together.

The unit also comprises impeller means 4 operative to cause air to flow through the air inlet 13 into the inlet chamber, through the valve chamber 16, through the outlet chamber 14 and through the air outlet 15 from the unit.

Located within the valve chamber, and defined by sheet metal walls 26 is an ancillary chamber 28 which is so located that the inlet and outlet branches **24*a* and 24*b* of the core passage both open thereinto; mounted in the valve chamber is a valve means comprising flap or vanelike valve members 30 and 32, the valve member 30 also being operative in part within the ancillary chamber 28**.

The valve means also comprises motive means, afforded a valve motor 34, which is operative to rotate the valve member 32, a link 36 extending from the valve member 32 to the valve member 30 causing said valve member 30 to be rotated simultaneously with the valve member 32.

Figure 2:
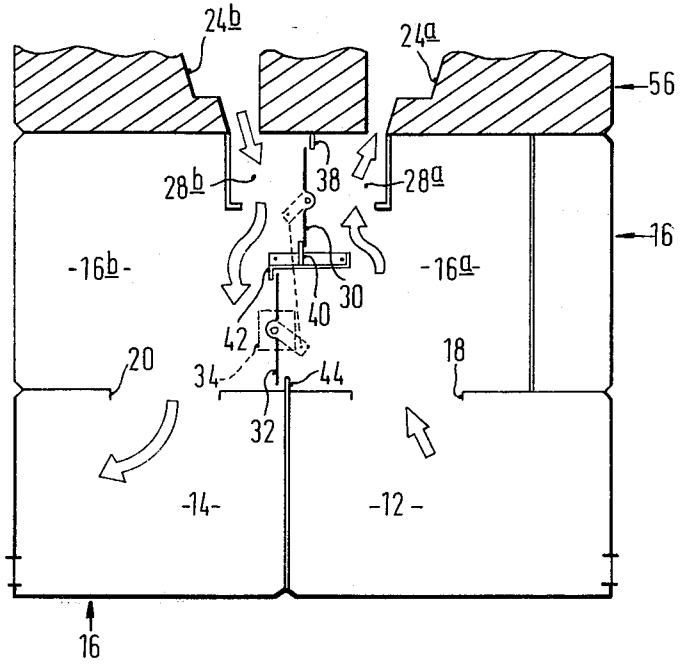
FIG. 2 is an enlarged view showing valve means of the first embodiment in a first condition, in which the heat storage unit is operating in its heating condition.
Figure 3:
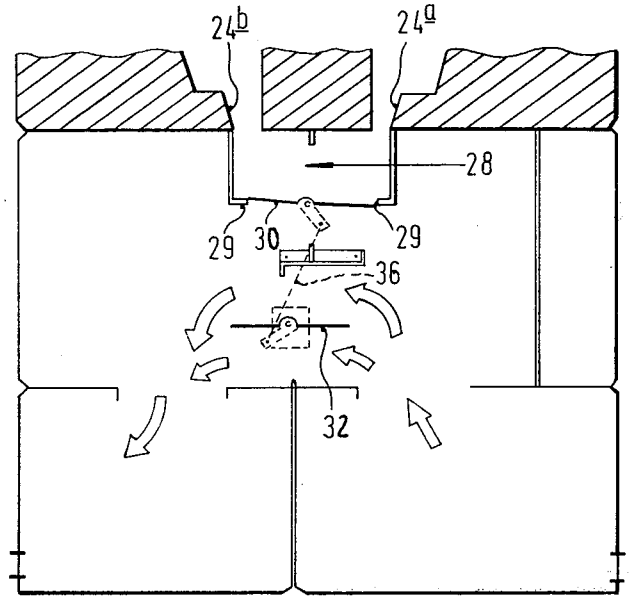
FIG. 3 is a view similar to that shown in FIG. 2, showing the valve means in a second condition, in which the heat storage unit is operating in a cool running condition.

The valve motor 34 is operative to move the valve means between a first condition (shown in FIG. 2) and a second condition (shown in FIG. 3). In said first condition, the valve members 30, 32 adopt positions, in co-operation with flanges 38, 40 and 42, 44 respectively to effect division of the valve chamber 16 into two parts, an inlet section **16*a* which is in communication with both the opening 18 and with the inlet section 24*a* of the core passage, and an outlet section 16*b* which is in with the opening 20 and with the outlet section 24*b* of the core passage (see FIG. 2). Thus, operation of the impeller means is effective to cause air to flow from the air inlet, through the first said part of the valve chamber, through the intermediate chamber and through the core passage to the other said part of the valve chamber, and from there through the air outlet 15** via the outlet chamber: in this condition of valve means, the air drawn by the impeller means flows between the heat storage elements of the unit, and is in consequence heated during its flow through the unit.

In the second condition of the valve means, the valve members 30 and 32 adopt the positions shown in FIG. 3, in which direct flow through the valve chamber from the opening 18 to the opening 20 is permitted. The valve member 30 co-operates with flanges 29,29 provided by the walls 26 defining the ancillary chamber 28, to close the ancillary chamber off from the valve chamber 16, whilst the second valve member 32 presents minimum impedance to flow of air through the valve chamber from the inlet to the outlet (see FIG. 3).

Flow of air across the valve member 30 is not effective to produce any significant pressure differential between the inlet section **24*a* and the outlet section 24*b* of the core passage, as would tend to cause an undesired leakage of air through the core passage, to cause air flowing directly through the valve chamber to extract heat from the heat storage elements. Should any small positive or negative pressure differential be caused in the intermediate chamber in relation to the valve chamber, this will be effective in relation both to the point of exit of the core passage from the intermediate chamber, and to the point of return of such core passage to the ancilliary chamber, and no differential pressure between these points will be developed, as aforesaid. Thus, the requirement of the valve member 30 to provide sealing engagement with the flanges 27, to completely seal off the ancilliary chamber 28**, is not required.

Additionally, in that the valve member 30 and the flanges 27 are somewhat removed from the heat storage elements, they are removed from the regions of the heat storage unit of high temperature, and are not deleteriously effected in the same manner as valve members closing the inlet and/or outlet sections **24*a* and 24*b*** of the core passage directly.

Thus, the heat storage unit which is the preferred embodiment of this invention can operate in a "cool running" condition (shown in FIG. 3) with no significant leakage of heat from the storage section 22. Thus, the impeller means of the unit can be utilised to provide for circulation of air to the room or premises being served by the unit, without the disadvantages herein above discussed. Furthermore, the effective isolation of the heat storage section when operating the unit in its cool running condition permits the heat storage unit to be used in conjunction with a cooling means, effective to reduce the temperature of the air delivered by the impeller means to the room being served.

Thus, the impeller means 4 in the preferred embodiment is operative to draw air from the unit and to deliver such air through a supplementary chamber 45, and to the room or premises being served by outlet ducting 49. Located in the supplementary chamber is a cooling coil 46, and a supplementary direct heating element 48.

Thus, when the device is operating in its heating condition, heat is drawn through the device in part by way of the core passage 24, and if the temperature of the air delivered from the unit is not sufficient to meet prevailing requirements, or if it is desired not to deplete the heat stored in the core of the storage unit, additional heat may be imparted to the flow of air emitted from the device by the direct heating elements 48.

Conversely, when the device is operating in its cool running condition, if desired the cooling element 46 may be operated to further lower the temperature of air emitted from the device.

During normal operation of the heat storage unit, operation of the motor 34 to control the position of the valve members 30, 32 is under the control of a temperature sensor, conveniently in the form of an hydraulic (capillary) thermostat 59, which senses the temperature of air either immediately prior to its entry into, or its exit from, the impeller means 4, in conjunction with a preset control which establishes the criteria of temperature which the unit is required to meet. With the valve members 30, 32 in their closed positions (FIG. 3), when the temperature sensor 59 senses that the temperature of air passing into the impeller means 4 has fallen below the required temperature, it will cause the motor 34 to operate to move the valve members 30, 32 from their FIG. 3 position towards their FIG. 2 position. When the temperature sensor 59 detects the attainment of a desired temperature, operation of the motor 34 will terminate, and the valve members 30, 32 will remain in their position (which may be the position shown in FIG. 1) until the temperature sensor 59 detects a change in the temperature of air flowing into the impeller means 4, or until a change in the temperature requirement is indicated, for example by the operation of manual control means. When this happens, the motor 34 will move the valve members 30, 32 either towards their FIG. 2 position or towards their FIG. 3 position, depending upon whether too low or too high a temperature, respectively, has been detected by the sensor means 59. In the circumstances where, with the valve members 30 and 32 in their FIG. 2 position, the temperature of air flowing across the thermostat 59 does not meet the required temperature conditions, the auxiliary heating means 48 may be energised, control of which being conveniently effected by a secondary temperature sensor 50.

Whereas in the first embodiment described above, a single motor 34 is utilised to move both valve members 30, 32 simultaneously, if desired two motors may be used. Such two motors may be identical and continuously variable in their position of the valve members, or it may be possible that one of the two motors is of a two-position type, whereby the vane associated with that motor would either by fully open or fully closed, fine control over the rate of extraction of heat from the storage unit being controlled by the position of the other, continuously positionally variable, valve member.

Figure 4:
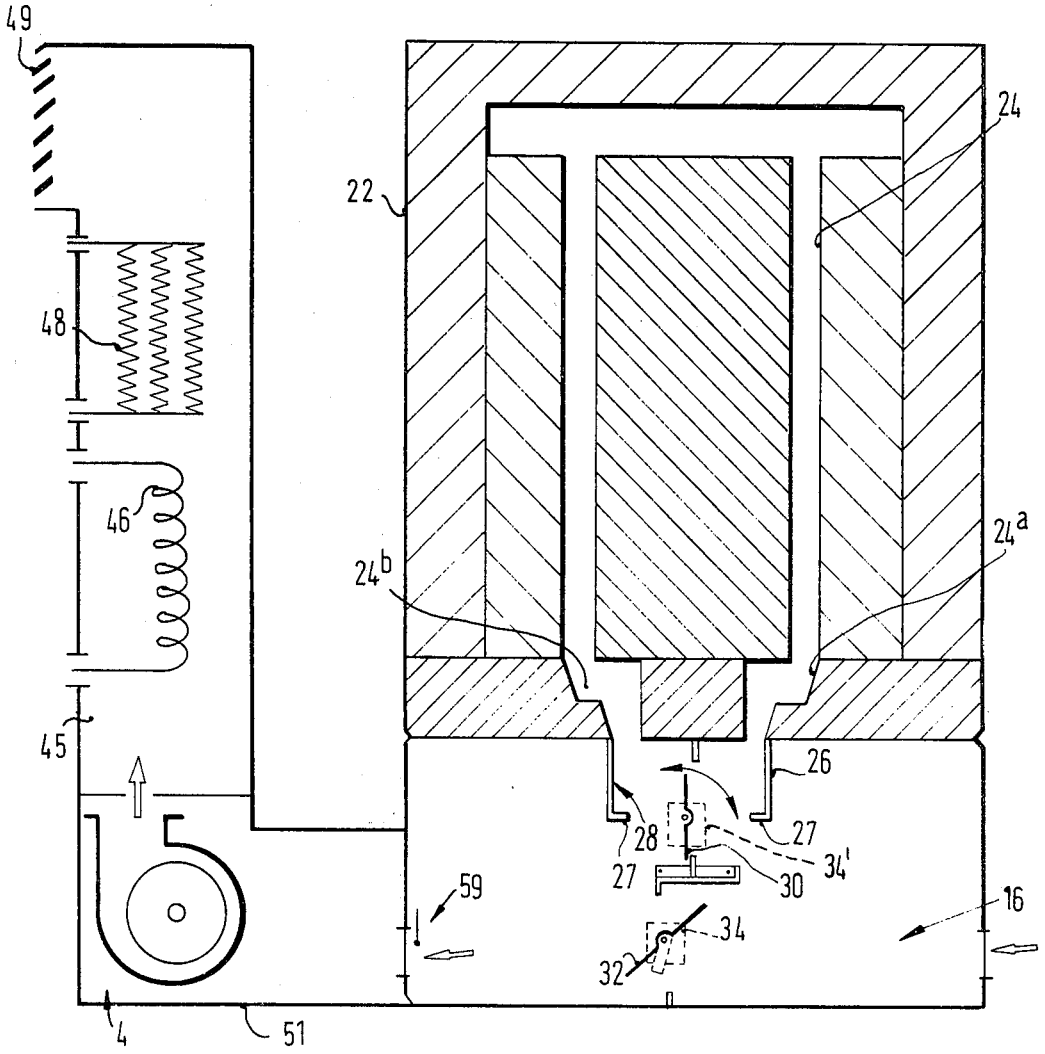
FIG. 4 is a schematic cross-sectional view of a heat storage unit which is a second embodiment of the invention, which also illustrates the invention.

Thus, in the heat storage unit which is the second embodiment of the invention, illustrated in FIG. 4 of the accompanying drawings, when the heat storage unit is in a "cool running" condition, the valve members 30 and 32 will adopt the positions in which they are shown in FIG. 3. When the temperature sensor 59 indicates, in conjunction with the preset control, that heating of the outflowing air is required, the motive means will be operative to cause the drive motor 34 to rotate the valve member 30 through 90°, to the position shown in FIG. 4. The motive means simultaneously operates the motor 34 slowly to rotate the valve member 32 in a clockwise direction, causing some air flowing from the inlet section of the valve chamber 16 to the outlet section of the valve chamber 16 to flow by way of the heat storage passage 24. When the temperature of the sensor 59 indicates the attainment of a desired temperature, rotation of the valve member 32 by the motor 34 will cease.

In the embodiment shown in FIG. 4, the impeller unit, supplementary cooling device 46 and supplementary heating device 48 are separated from the main body of the storage unit itself, being connected thereto by a short length of ducting 51. This permits a modular construction to be used, in which a specific auxiliary unit is connected to the storage unit, which auxiliary unit is selected in accordance with the perameters required to be met by the system as a whole. Thus, a heat storage unit of standard design may be connected to an auxiliary unit, the size of the impeller unit of which, and/or size of the cooling core of which, and/or the size of the auxiliary heating elements of which, are selected to meet the prevailing requirements.

I claim:

1. A heat storage unit comprising:

a housing;

an air inlet and an air outlet extending into the housing; means within the housing defining a flow path extending between the inlet and the outlet;

heat storage elements mounted in the housing, said heat storage elements defining passage means extending between the heat storage elements, said passage means communicating with an opening in an ancillary chamber in the housing;

impeller means on the housing and which is operative to cause air flow into the air inlet and from the air outlet;

a valve member mounted adjacent to the opening in the ancillary chamber; drive means connected to said valve member and which is operative to move the valve member between a first position in which said valve member divides the ancillary chamber into an inlet section in communication with an upstream flow section of the heat storage elements and an outlet section in communication with a downstream flow section of the heat storage elements, and a second position in which the valve member extends across the opening of the ancillary chamber to close the opening;

whereby when the valve member is in its first position the impeller means is operative to cause air to flow from the inlet to the outlet through said heat storage elements, and when the valve member is in its second position said impeller means is operative to cause air to flow from the inlet to the outlet with no significant flow of air through said heat storage elements.

2. A heat storage unit according to claim 1 including:

a valve chamber in communication with the ancillary chamber;

an inlet chamber having an inlet for receiving air and an air outlet communicating with the valve chamber; and an outlet chamber having an air inlet communicating with the valve chamber and an air outlet communicating with the impeller means;

whereby when the valve member is in its second position air can flow in a stream from the inlet chamber, to the valve chamber to the outlet chamber without passing through the heat storage elements.

3. A heat storage unit according to claim 2 in which the inlet chamber and the outlet chamber are beneath the valve chamber, the inlet chamber outlet in communication with the valve chamber is in the top of the inlet chamber, and the outlet chamber inlet in communication with the valve chamber is in the top of the outlet chamber.

4. A heat storage unit comprising:

a housing;

an air inlet and an air outlet extending into the housing;

heat storage elements mounted in the housing, said heat storage elements defining passage means extending between the heat storage elements, said passage means opening into an ancillary chamber in the housing;

impeller means on the housing and which is operative to cause air to flow into the housing through the air inlet and from the air outlet;

means to divide part of a flow path between the inlet and the outlet into a first flow passage which extends across an opening of the ancillary chamber and a second flow passage spaced from said opening;

a first valve member mounted adjacent to said opening;

first drive means connected to said first valve member and which is operative to move the valve member between a first position in which said valve member divides the ancillary chamber into an inlet section in communication with an upstream section of the first flow passage and an outlet section in communication with a downstream section of the first flow passage, and a second position in which the valve member extends across the opening of the ancillary chamber to close the opening;

a second valve member mounted in the second flow passage; and second drive means connected to the second valve member to move said second valve member between a first position in which it provides a greater restriction to flow of air from the inlet to the outlet by way of said second flow passage and a second position in which it provides a lesser restriction to such air flow, whereby when the first valve member is in its first position and the second valve member is in its first position the impeller means is operative to cause air to flow from an inlet to the outlet predominantly wholly through said passage means, and when the first and second valve members are in their second positions said impeller means is operative to cause air to flow from the inlet to the outlet with no significant flow of air through said passage means; and one of said valve members being positionally variable between said first and second positions so as to obtain a flow of air from the inlet to the outlet both directly and by way of said passage means.

5. A heat storage unit according to claim 4 wherein the second valve member when in its second position presents minimum impedance to air flow through the valve chamber from the air inlet to the air outlet.

6. A heat storage unit according to claim 4 wherein both the valve members are continuously positionally variable, and the drive means is operative to move the valve members between their first and second positions synchronously to vary the proportions of air flowing from the inlet to the outlet by way of the heating passage and other than by way of the heating passage.

7. A heat storage unit according to claim 4 wherein the first valve member is bi-stable, and the proportions of air flowing from the inlet to the outlet by way of the heating passage and other than by way of the heating passage is varied by variable positioning of the first valve member, the drive means being operative to move the first valve member between its first and second positions and to move the second valve member to a desired position between its first and second positions.

8. A heat storage unit according to claim 7 wherein the drive means is afforded by a drive motor which is operative both under the influence of a temperature sensing device operative to sense the temperature of air flowing from the device, and a preset control.

9. A heat storage unit according to claim 4 wherein the outlet is connected to an auxilliary unit through which air flows from the heat storage unit to a room being served, said auxilliary unit providing a housing which mounts means to heat air flowing therethrough, and means to cool air flowing therethrough, which may be brought into operation as may be desired.

10. A heat storage unit according to claim 4 including:

a valve chamber in communication with the ancillary chamber;

an inlet chamber having an inlet for receiving air and an air outlet communicating with the valve chamber;

an outlet chamber having an air inlet communicating with the valve chamber and an air outlet communicating with the impeller means; and the second flow passage being in the valve chamber.

11. A heat storage unit according to claim 10 in which the second flow passage is defined at least in part by the means dividing the flow path into first and second flow paths, and in part by the valve chamber wall.

12. A heat storage unit according to claim 10 in which the first valve member and the second valve member, when both are in their first positions effectively divide the valve chamber into two parts so that air after entering the valve chamber must flow through the heat storage elements before leaving the valve chamber.

13. A heat storage unit according to claim 10 in which the inlet chamber and the outlet chamber are beneath the valve chamber, the inlet chamber outlet in communication with the valve chamber is in the top of the inlet chamber, and the outlet chamber inlet in communication with the valve chamber is in the top of the outlet chamber.

* * * * *